US005457016A

United States Patent [19]

Dethlefs

[11] Patent Number: 5,457,016

[45] Date of Patent: Oct. 10, 1995

[54] PHOTOGRAPHIC SUPPORT MATERIAL WITH POLYOLEFIN BACK COATING BLEND

[75] Inventor: Ralf-Burkhard Dethlefs, Osnabrück, Germany

[73] Assignee: Felix Schoeller jr. Papierfabriken GmbH & Co. KG, Osnabruck, Germany

[21] Appl. No.: 114,007

[22] Filed: Aug. 30, 1993

[30] Foreign Application Priority Data

Sep. 1, 1992 [DE] Germany ..... 42 29 153.4

[51] Int. Cl.[6] ..... G03C 1/76

[52] U.S. Cl. ..... 430/531; 430/538; 430/496; 430/532; 430/536; 428/323; 428/218

[58] Field of Search ..... 430/531, 538, 430/496, 532, 536; 428/323, 218

[56] References Cited

U.S. PATENT DOCUMENTS

| | | | |
|---|---|---|---|
| 4,389,455 | 6/1983 | Asno | 430/538 |
| 4,699,874 | 10/1987 | Kitagawa et al. | 430/538 |
| 4,935,298 | 6/1990 | Dethlefs | 428/323 |
| 5,104,722 | 4/1992 | Kojima et al. | 430/538 |
| 5,178,936 | 1/1993 | Kamiya et al. | 430/538 |

FOREIGN PATENT DOCUMENTS

| | | |
|---|---|---|
| 1772347 | 3/1971 | Germany . |
| 3244319 | 6/1983 | Germany . |
| 3716269 | 11/1988 | Germany . |

*Primary Examiner*—Thomas R. Neville

*Attorney, Agent, or Firm*—Lockwood, Alex, Fitzgibbon & Cummings

[57] ABSTRACT

A photographic support material has a back coating comprising a blend of a polypropylene and low density polyethylene.

8 Claims, No Drawings

PHOTOGRAPHIC SUPPORT MATERIAL WITH POLYOLEFIN BACK COATING BLEND

DESCRIPTION OF INVENTION

The present invention relates to a photographic support material having synthetic resin layers applied to both sides.

Photographic support materials mainly comprise a photographic base paper with synthetic resin coatings. These synthetic resin coatings are usually applied on both sides of the carrier and comprise a clear unpigmented layer of polyolefin on the back of the base paper, and a layer of polyolefin filled with white pigment on the front side. The front side is the side that will later carry the light sensitive photographic emulsions, and ultimately the developed image.

The flatness of such an support material is assured if the coatings on the front and back sides are approximately identical. In a subsequent operation, however, only the front side is coated with the light sensitive photographic emulsions, so that this balance no longer exists because the front and back sides are no longer identical.

In order to compensate for this additional coating on the front side, the coating on the back side is reinforced already in the production of the support material in such a way that the subsequent total product is again completely flat. This can be accomplished by increasing the layer thickness of the coating on the back side or by means of a coating material having a reinforced tensile strength or a greater rigidity, or by applying additional so called anticurl layers.

Normally the synthetic resin in the case of photographic support materials is a polyethylene. In order to assure that the end product will be flat, approximately 30 to 35% more HDPE (high density polyethylene) is usually added to the coating on the back than to the coating on the front. In contrast with LDPE (low density polyethylene), HDPE has a greater crystallinity, contains a larger amount of stabilizers and residues of catalysts and acid acceptors, and contains more areas of high molecular accumulations (gel particles). The gel particles cause problems in the form of nonmelting areas. When the amount of HDPE in the coating composition is increased, this leads to difficulties in extrusion due to a faster buildup of pressure in the extruder, which in turn is caused by increased residues on the screens, and leads to increased rejects due to the higher molecular gel particles in the coating which cannot be broken up in the melt. The greater crystallinity and the higher stabilizer content, in turn, interfere with adhesion to the base paper.

One possibility of preventing the curl phenomenon and assuring that the photographic support material will be flat enough is described in German Patent DOS 17 72 347. In Example 5 of that patent specification the coating on the front side consists of polyethylene and a white pigment, and the coating on the back side consists of polypropylene. However, the processing conditions for polypropylene in the melt extruder differ from those for a polyethylene, for example, in terms of the melt temperature and pressure, and even in a difference in the geometry of the extruder screw if the process is to be carried out under optimal conditions. Also, if the extruders are used for both polyolefins, a certain time loss for switching from one to the other must be included in planning schedules. Furthermore, the adhesion of polypropylene to the paper surface is much worse than that of LDPE.

Such adhesion problems are solved in WO 90-002 973 by means of coextrusion. In that patent, the coating on the back of the base paper consists of at least two layers, for example an adhesive layer and a layer of polypropylene in order to adjust the curl properties. However, this type of coating requires the more expensive processing technique of coextrusion.

Therefore, the task of this invention is to develop a coating for the back side of a photographic support material which is based on the process of melt extrusion and which assures that the photographic support material will lie flat after applying the emulsion coating and after exposure of the image, without requiring difficult or complicated production conditions or a lower adhesion of the layers, or without resulting in an increased gel particle content in the coating.

This problem is solved by means of a photographic support material which comprises a carrier and synthetic resin coatings applied to both sides, whereby the synthetic resin layer on the back either entirely or mainly comprises a blend of low density polyethylene (LDPE) and a polypropylene homopolymer and/or polypropylene copolymer of at least 80 wt % propylene and at most 20 wt % of at least one other olefin.

The low density polyethylene used in the blend may also be a linear low density polyethylene (LLDPE) and/or a polyethylene/($C_3$–$C_8$)-α-olefin copolymer.

The polypropylene homopolymer and the polypropylene copolymer may be composed of 80 to 100 wt % propylene and 0 to 20 wt % ($C_2$ to $C_4$) olefin, preferably ethylene.

It is especially preferred to use a polypropylene homopolymer and a polypropylene copolymer with a narrow molecular weight distribution of $M_w/M_n$=<6, which results in improved flow properties, better drawability and a lower water vapor permeability, where $M_w$=weight-average molecular weight, and $M_n$=number-average molecular weight.

The blend may also contain up to 20 wt % of other polyolefins, such as high density polyethylene (HDPE).

The blend may also contain up to a total of 20 wt % white pigments (such as titanium dioxide), colored pigments (such as ultramarine blue), organic and inorganic fillers (such as silicon dioxide), optical brighteners (such as stilbene derivatives), lubricants (such as waxes), separating agents (such as fluoropolymers), antistatics (such as ethoxylated tertiary amines), and other conventional additives (such as antioxidants and age retardants).

The amount of polypropylene homopolymer and/or polypropylene copolymer in the blend according to this invention is 2 to 75 wt %.

Low density polyethylene (LDPE) is considered to be polyethylene that has a specific gravity of 0.91 to 0.94 g/cm$^3$. High density polyethylene (HDPE) is polyethylene that has a specific gravity of 0.94 to 0.97 g/cm$^3$.

There is no problem in processing the blend according to this invention with the screw extruders that are also used for pure polyethylene.

The gel particle content in the coating is eliminated or reduced to a tolerable level by completely or partially replacing HDPE with a polyproplyene homopolymer or copolymer.

The amount of polypropylene homopolymer or copolymer actually needed for the photographic support material or the image bearing end product to be flat depends on the amount of HDPE or other polyolefins in the coating on the front and back of the support material, and on the difference between the weights of the coatings applied to the front and back sides.

The synthetic resin layers are prepared by the melt extrusion method and applied to a carrier, in which case the carrier is preferably subjected to a surface activation pretreatment, such as a corona pretreatment, in order to improve the adhesion of the layers to the carrier.

Suitable carriers include plastic films, textiles and papers. The plastic films are usually polyester films, and the papers are usually photographic base papers. Photographic base papers are the preferred carriers.

The photographic support material produced in this way may contain other conventional auxiliary layers or functional layers, such as primer or adhesive layers, antistatic layers, anticurl layers, reinforcing layers or layers that can be written or printed upon.

The following examples are presented in order to illustrate this invention without restricting it in any way.

EXAMPLES

A neutral sized photographic base paper with a basis weight of 175 g/m$^2$ was coated successively by means of a melt extrusion method as described below.

First, the back of the base paper was coated after a corona pretreatment, and then the front side of the base paper was coated after a corona pretreatment.

The machine speed in the extruder was 150 m/min and the melt temperatures were between 290° C. and 320° C.

Table 1 below lists the polyolefin blends and the weights of the applied coatings.

TABLE 1

Composition and Amount of Synthetic Resin Layers Applied

| | Coating on the Back, wt % | | | | | | Coating on the Front, wt % | | | | | |
|---|---|---|---|---|---|---|---|---|---|---|---|---|
| | LDPE | | HDPE | LLDPE | PP | | LLDPE | | HDPE | White Masterbatch with 50 wt % $TiO_2$ | | Amount Applied by Weight per Side, g/m$^2$ |
| | g = 0.924 g/cm$^3$ | g = 0.934 g/cm$^3$ | g = 0.958 g/cm$^3$ | g = 0.919 g/cm$^3$ | Homopol. g = 0.905 g/cm$^3$ | PP Copol.* g = 0.908 g/cm$^3$ | g = 9.922 g/cm$^3$ | g = 0.924 g/cm$^3$ | g = 0.958 g/cm$^3$ | Rutile | Antase | |
| B1 | 40 | — | — | — | 60 | — | 36 | 35 | 8 | 21 | — | 30 |
| B2 | 50 | — | — | — | 50 | — | 55 | 25 | — | 20 | — | 25 |
| B3 | 35 | 25 | 15 | — | 25 | — | 36 | 35 | 8 | 21 | — | 25 |
| B4 | 35 | — | — | 20 | 45 | — | 36 | 35 | 8 | — | 21 | 25 |
| B5 | 40 | — | 15 | — | 45 | — | 55 | 25 | — | 20 | — | 30 |
| B6 | 35 | — | 15 | — | — | 50 | 55 | 25 | — | 20 | — | 25 |
| V1 | 35 | 25 | 40 | — | — | — | 36 | 35 | 8 | 21 | — | 30 |
| V2 | 15 | 25 | 40 | 20 | — | — | 36 | 35 | 8 | 21 | — | 30 |
| V3 | 30 | 20 | 30 | 20 | — | — | 55 | 25 | — | 20 | — | 25 |

*Block copolymer with 15 wt % ethylene

0

TEST RESULTS

The curl was measured on circular test objects with a diameter of 17 cm. These disks were stored for 4 days or 14 days at 80% relative atmospheric humidity and 23° C. in a climate controlled chamber.

The curl was measured as follows:

Curl toward the front is given a sign of plus (+).

Curl toward the back is given a sign of minus (−)

It is assumed that the curvature or curl of the punched disk describes an arc. This assumed full circle is divided into eighths.

The curl is expressed in eighths, for example:

A curl of 8 would be 8/8=1 complete circle,

A curl of 4 would be 4/8=½circle, and

A curl of 1 would be 1/8=⅛circle.

The value is measured with stencils.

The gel particle content is determined on 1 m$^2$ samples in oblique illumination. The gel particles can be seen as small elevations. The gel particle content is evaluated as follows:

slight=<5 gel particles/m$^2$ medium=5 to 15 gel particles/m$^2$ high=>15 gel particles/m$^2$ Table 2 shows the test results.

TABLE 2

Test Results

| Example | Curl 80% relative atmospheric humidity after 4 days | 14 days | Gel particle content |
|---|---|---|---|
| B1 | −0.9 | −1.1 | None |
| B2 | −0.7 | −0.9 | None |
| B3 | −0.6 | −0.9 | Slight |
| B4 | −0.7 | −1.1 | None |
| B5 | −0.8 | −1.1 | Slight |
| B6 | −0.8 | −1.1 | Slight |
| V1 | −0.7 | −1.1 | High |
| V2 | −0.8 | −1.1 | High |

TABLE 2-continued

Test Results

| Example | Curl 80% relative atmospheric humidity after 4 days | 14 days | Gel particle content |
|---|---|---|---|
| V3 | −0.6 | −0.9 | Medium |

For reasons of simplicity, only one polypropylene copolymer was listed in Example B6. Similar results with equivalent conclusions were also obtained with polypropylene copolymers with 1.5 wt % and 4.0 wt % ethylene, and with a polypropylene block copolymer containing 10 wt % ethylene.

The slight curl toward the rear achieved with all support material is desirable because this is approximately compensated by the light sensitive photographic emulsion layers yet to be applied.

These results show that by replacing HDPE with a polypropylene homopolymer or copolymer in the coating on the back side of photographic support material, the curl can be kept at the same level, while the number of gel bodies is reduced. This makes it possible to reduce the number of rejects. Moreover, a change in formulations can be implemented without any changes in the machine design.

I claim:

1. A photographic support material for light sensitive materials comprising a carrier having a front side and a back side opposite the front side; synthetic resin layers applied to both sides, the layer on the front side being a polyolefin adapted to receive the light sensitive materials and the layer on the back side being adhered directly to the carrier; and the synthetic resin layer on the back side comprises a blend of:

a. low density polyethylene (LDPE), b. about 2–75 wt % polypropylene homopolymer and/or polypropylene copolymer of at least 80 wt % propylene and at most 20 wt % of an olefin other than the polypropylene; and c. 0–20 wt % of at least one other polyolefin.

2. The photographic support material of claim 1, wherein the carrier is a photographic base paper.

3. The photographic support material of claim 1 wherein the polypropylene copolymer comprises at least 80 wt % propylene and at most 20 wt % ethylene.

4. The photographic support material of claim 1, wherein the polypropylene homopolymer and/or the polypropylene copolymer has a molecular weight distribution of <6.

5. The photographic support material of claim 1, wherein the low density polyethylene is partially or entirely a linear low density polyethylene (LLDPE).

6. The photographic support material of claim 1, wherein said one other polyolefin is a high density polyethylene (HDPE).

7. The photographic support material of claim 1, wherein the synthetic resin layer on the back side contains a total of up to 20 wt % of additives from the group consisting essentially of white pigments, colored pigments, optical brighteners, lubricants, separating agents, antistatics, and organic and inorganic fillers.

8. The photographic support material of claim 1, wherein the support material also contains other functional layers which include at least one of primer/adhesive layers, antistatic layers, anticurl layers, reinforcing layers, writable layers and printable layers.

* * * * *

UNITED STATES PATENT AND TRADEMARK OFFICE

CERTIFICATE OF CORRECTION

PATENT NO. : 5,457,016

DATED : October 10, 1995

INVENTOR(S) : Ralf-Burkhard Dethlefs

It is certified that error appears in the above-indentified patent and that said Letters Patent is hereby corrected as shown below:

Col. 5, line 21, after "polyolefin" insert --and--.

Signed and Sealed this

Twenty-second Day of October, 1996

*Attest:*

BRUCE LEHMAN

*Attesting Officer*

*Commissioner of Patents and Trademarks*